US007644556B2

(12) United States Patent
Grohman et al.

(10) Patent No.: US 7,644,556 B2
(45) Date of Patent: Jan. 12, 2010

(54) PLANKING SYSTEM AND METHOD

(75) Inventors: Martin Grohman, Biddeford, ME (US); Robert G. Rottinghaus, Saco, ME (US)

(73) Assignee: Correct Building Products, L.L.C., Biddeford, ME (US)

( * ) Notice: Subject to any disclaimer, the term of this patent is extended or adjusted under 35 U.S.C. 154(b) by 76 days.

(21) Appl. No.: 11/940,426

(22) Filed: Nov. 15, 2007

(65) Prior Publication Data

US 2009/0126307 A1 May 21, 2009

(51) Int. Cl.
*E04B 2/00* (2006.01)
*E04B 1/343* (2006.01)
*E04D 1/00* (2006.01)

(52) U.S. Cl. ..... 52/592.1; 52/573.1; 52/539

(58) Field of Classification Search ..... 52/592.1, 52/177, 539, 573.1, 393; 428/192; 403/339, 403/364

See application file for complete search history.

(56) References Cited

U.S. PATENT DOCUMENTS 329,616 A * 11/1885 Baldwin ..... 52/578
502,289 A * 8/1893 Feldmann ..... 52/578
752,694 A * 2/1904 Lund ..... 52/592.4
1,206,484 A * 11/1916 Swan ..... 52/223.3
1,374,082 A * 4/1921 Hedges ..... 52/578
1,764,331 A * 6/1930 Moratz ..... 52/364
1,808,591 A * 6/1931 Bruce ..... 52/592.4
1,846,658 A * 2/1932 Rockwell ..... 403/265
1,864,774 A * 6/1932 Storm ..... 52/403.1
2,823,433 A * 2/1958 Kendall ..... 52/591.1
2,947,040 A * 8/1960 Schultz ..... 52/592.4
3,253,842 A * 5/1966 Rabe ..... 285/81
3,347,048 A * 10/1967 Brown et al. ..... 405/16
3,474,584 A * 10/1969 Lynch ..... 52/309.13
3,579,941 A * 5/1971 Tibbals ..... 52/384
3,807,113 A * 4/1974 Turner ..... 52/314
4,095,913 A * 6/1978 Pettersson et al. ..... 403/364
4,100,710 A * 7/1978 Kowallik ..... 52/309.9
4,337,607 A * 7/1982 Boschetti ..... 52/573.1
4,376,593 A * 3/1983 Schaefer ..... 403/231
4,471,012 A * 9/1984 Maxwell ..... 428/106
4,575,981 A * 3/1986 Porter ..... 52/309.9
4,695,502 A * 9/1987 Rush ..... 428/192
5,133,620 A * 7/1992 Scheiwiller ..... 404/37
5,303,526 A * 4/1994 Niese ..... 52/393
5,335,473 A * 8/1994 Chase ..... 52/745.08

(Continued)

FOREIGN PATENT DOCUMENTS

FR 2425306 A * 1/1980

(Continued)

*Primary Examiner*—Robert J Canfield
*Assistant Examiner*—Charissa Ahmad
(74) *Attorney, Agent, or Firm*—Hovey Williams LLP

(57) ABSTRACT

A novel planking system utilizing an inventive groove design is provided. The novel groove is defined by two opposing side walls and a groove end wall. The groove side walls present two generally opposed tongue-engaging projections that automatically provide a uniform space between planks during installation, and accommodate expansion of the planks after installation by breaking away when force is exerted on the projections by an adjacent plank. The present invention is also concerned with a combination of planks having an inventive tongue-and-groove configuration, as well as inventive methods of assembling planks to accommodate the expansion and contraction of the assembled planks after installation.

15 Claims, 5 Drawing Sheets

U.S. PATENT DOCUMENTS 5,502,939 A * 4/1996 Zadok et al. ..... 52/309.9
5,548,938 A * 8/1996 Scheiwiller ..... 52/604
5,661,937 A * 9/1997 Doppler et al. ..... 52/410
5,694,730 A * 12/1997 Del Rincon et al. ..... 52/586.1
5,836,128 A * 11/1998 Groh et al. ..... 52/580
6,035,588 A * 3/2000 Zehner et al. ..... 52/98
6,098,365 A * 8/2000 Martin et al. ..... 52/592.1
6,101,778 A * 8/2000 Mårtensson ..... 52/582.1
6,131,355 A 10/2000 Groh et al.
6,145,261 A * 11/2000 Godfrey et al. ..... 52/302.1
6,209,278 B1 * 4/2001 Tychsen ..... 52/592.4
6,216,409 B1 * 4/2001 Roy et al. ..... 52/589.1
6,216,410 B1 * 4/2001 Haberman ..... 52/591.1
6,272,808 B1 * 8/2001 Groh et al. ..... 52/592.1
6,363,677 B1 * 4/2002 Chen et al. ..... 52/586.1
6,385,936 B1 * 5/2002 Schneider ..... 52/589.1
6,397,547 B1 * 6/2002 Mårtensson ..... 52/582.1
6,397,548 B1 * 6/2002 Martin et al. ..... 52/592.4
6,412,245 B1 * 7/2002 Lane et al. ..... 52/586.1
6,418,683 B1 * 7/2002 Martensson et al. ..... 52/282.1
6,421,970 B1 * 7/2002 Martensson et al. ..... 52/282.1
6,423,257 B1 * 7/2002 Stobart et al. ..... 264/145
6,438,919 B1 * 8/2002 Knauseder ..... 52/586.2
6,521,314 B2 * 2/2003 Tychsen ..... 428/60
6,581,351 B2 * 6/2003 DeVivi ..... 52/592.1
6,588,166 B2 * 7/2003 Martensson et al. ..... 52/578
6,601,359 B2 * 8/2003 Olofsson ..... 52/588.1
6,606,834 B2 * 8/2003 Martensson et al. ..... 52/578
6,675,544 B1 * 1/2004 Ou et al. ..... 52/539
6,682,254 B1 * 1/2004 Olofsson et al. ..... 403/375
6,718,721 B2 * 4/2004 Albany et al. ..... 52/588.1
6,737,006 B2 * 5/2004 Grohman ..... 264/211.21
6,739,106 B2 * 5/2004 Curatolo ..... 52/592.1
D497,008 S * 10/2004 Germany et al. ..... D25/113
6,851,237 B2 * 2/2005 Niese et al. ..... 52/480
6,851,241 B2 * 2/2005 Pervan ..... 52/592.1
6,862,857 B2 * 3/2005 Tychsen, Detlef ..... 52/582.1
6,865,855 B2 * 3/2005 Knauseder ..... 52/592.1
6,880,307 B2 * 4/2005 Schwitte et al. ..... 52/592.1
6,968,664 B2 * 11/2005 Thiers et al. ..... 52/592.1
7,047,697 B1 * 5/2006 Heath ..... 52/177
7,051,486 B2 * 5/2006 Pervan ..... 52/586.1
7,107,731 B2 * 9/2006 Record ..... 52/309.9
7,121,058 B2 * 10/2006 Palsson et al. ..... 52/592.2
7,127,860 B2 * 10/2006 Pervan et al. ..... 52/592.1
7,131,242 B2 * 11/2006 Martensson et al. ..... 52/591.3
7,169,460 B1 * 1/2007 Chen et al. ..... 428/195.1
7,188,456 B2 * 3/2007 Knauseder ..... 52/592.1
7,377,081 B2 * 5/2008 Ruhdorfer ..... 52/588.1
7,380,383 B2 * 6/2008 Olofsson et al. ..... 52/582.1
7,484,338 B2 * 2/2009 Pervan et al. ..... 52/588.1
7,497,058 B2 * 3/2009 Martensson ..... 52/582.1
2002/0059765 A1 * 5/2002 Nogueira et al. ..... 52/403.1
2002/0100242 A1 * 8/2002 Olofsson ..... 52/588.1
2002/0108323 A1 * 8/2002 Gruber ..... 52/177
2002/0108343 A1 * 8/2002 Knauseder ..... 52/592.1
2002/0170258 A1 * 11/2002 Schwitte et al. ..... 52/592.1
2003/0009971 A1 * 1/2003 Palmberg ..... 52/578
2003/0029117 A1 * 2/2003 Moriau et al. ..... 52/592.1
2003/0037504 A1 * 2/2003 Schwitte et al. ..... 52/586.1
2003/0041545 A1 * 3/2003 Stanchfield ..... 52/592.1
2003/0101681 A1 * 6/2003 Tychsen ..... 52/783.1
2003/0221387 A1 * 12/2003 Shah ..... 52/592.1
2004/0031227 A1 * 2/2004 Knauseder ..... 52/592.1
2004/0074181 A1 * 4/2004 Hunter, Jr. ..... 52/309.8
2004/0137180 A1 * 7/2004 Sjoberg et al. ..... 428/36.9
2006/0010818 A1 * 1/2006 Knauseder ..... 52/581
2006/0010820 A1 * 1/2006 Schwitte et al. ..... 52/592.1
2006/0272262 A1 * 12/2006 Pomberger ..... 52/589.1
2007/0022695 A1 * 2/2007 Magnusson ..... 52/592.1
2007/0113509 A1 * 5/2007 Zhang ..... 52/592.1
2007/0130872 A1 * 6/2007 Goodwin et al. ..... 52/592.1
2007/0193180 A1 * 8/2007 Plante ..... 52/592.1
2008/0041007 A1 * 2/2008 Pervan et al. ..... 52/506.01
2008/0222974 A1 * 9/2008 Perkowski et al. ..... 52/127.1
2009/0038253 A1 * 2/2009 Martensson ..... 52/582.1

FOREIGN PATENT DOCUMENTS

FR 2568163 A * 1/1986
WO WO 2004063492 A1 * 7/2004

* cited by examiner

PLANKING SYSTEM AND METHOD

BACKGROUND OF THE INVENTION

1. Field of the Invention

The present invention is broadly concerned with a novel planking system utilizing an inventive groove design, combinations of planks having an inventive tongue-and-groove configuration, and methods of assembling planks to accommodate the expansion and contraction of the assembled planks.

2. Description of the Prior Art

Wood panels and planks are commonly used for various structures, including decks, porches, walls, and the like. Composite materials offer many benefits over natural wood products for these uses, including improved durability and enhanced moisture resistance. However, wood composites still expand and contract with changes in temperature and moisture like natural wood, which can cause unwanted buckling when these products are used in tongue-and-groove arrangements. In particular, tongue-and-groove arrangements are commonly used in the construction of covered porches, where a small uniform space between each plank is desirable, and where wood composite materials have become increasingly popular. There are two main concerns that arise during the assembly and installation of porch planks when wood or wood composites are used. The first problem is efficiently creating a small space between the planks that is uniform and that can be maintained throughout the installation process. The second problem is accommodating the expansion and contraction of the planks after installation is complete.

Previous attempts to relieve the pressure between planks upon the expansion of the interconnected boards have utilized a "crush bead" located on the tip of the tongue of the plank in anticipation of it being crushed during expansion. Although these crush beads do create the desired space during installation, they do not always crush wider the compressive forces of the adjacent planks, resulting in buckling of the interconnected boards. This especially common in composite tongue-and-groove configurations due to the high compressive strength of the wood composite materials from which the planks and crush beads are formed. It is therefore desirable to have planks or panels with a tongue-and-groove configuration that create the desired space, while at the same time accommodating the expansion and contraction of the interconnected boards.

SUMMARY OF THE INVENTION

The present invention solves these problems by providing planks with a tongue-and-groove configuration providing generally opposed tongue-engaging projections on the side walls of the groove, which create the desired space that is maintained during installation.

In more detail, the present invention provides a plank configured to be assembled with an adjacent plank having a first edge surface and a tongue extending from the first edge surface. The tongue of the adjacent plank is defined by a tongue end wall and a pair of tongue side walls extending between the tongue end wall and first edge. The plank comprises a body presenting a second edge surface and a groove projecting inwardly from the second edge surface along a groove axis, with the groove being configured to receive the tongue of the adjacent plank. The groove is defined by a groove end wall and a pair of groove side walls that extend between the groove end wall and the second edge surface. The groove side walls present generally opposed tongue-engaging projections that are spaced from the groove end wall in alignment substantially perpendicular to the groove axis.

In another embodiment, there is provided a combination of planks comprising a first plank and a second plank utilizing a tongue-and-groove arrangement. The first plank presents a first edge surface, and a tongue extending from the first edge surface. The tongue comprises a tongue end wall and a pair of tongue side walls extending between the tongue end wall and the first edge surface. The second plank presents a second edge surface, and a groove projecting inwardly from the second edge surface along a groove axis and receiving the tongue of the first plank. The groove comprises a groove end wall and a pair of groove side walls extending between the groove end wall and the second edge surface. The groove side walls present generally opposed tongue-engaging projections that are spaced from the groove end wall in alignment substantially perpendicular to the groove axis.

In a further embodiment, a method of assembling porch planks to accommodate expansion and contraction of the assembled planks is provided. The method comprises securing a first plank to a support and positioning a second plank adjacent to the first plank. The first plank presents a first edge surface and a tongue extending from the first edge surface. The tongue comprises a tongue end wall and a pair of tongue side walls extending between the tongue end wall and the first edge surface. The second plank presents a second edge surface and a groove projecting inwardly from the second edge surface along a groove axis to receive the tongue. The groove comprises a groove end wall and a pair of groove side walls extending between the groove end wall and the second edge surface. The groove side walls present generally opposed tongue-engaging projections that are spaced from the groove end wall in alignment substantially perpendicular to the groove axis. The planks are assembled by inserting the tongue into the groove so that the tongue is received in the groove and the tongue end wall is engaged by the tongue-engaging projections, thereby providing an interior space between the tongue end wall and groove end wall, and first and second spaces between the first edge surface of the first plank and the second edge surface of the second plank.

Expansion of the planks after installation pushes the projections off edge-wise, exercising the projections in shear, instead of in compression. In this sense, the tongue-engaging projections are "shearable." Thus, when a given force is applied to the projections, they break away, relieving the pressure and preventing the buckling of the assembled planks.

Additional advantages of the novel tongue-and-groove configuration and method will be appreciated based upon the drawings and detailed description of the preferred embodiments below.

DETAILED DESCRIPTION OF THE PREFERRED EMBODIMENT

The following sets forth preferred embodiments in accordance with the present invention. It is to be understood, however, that these preferred embodiments are provided by way of illustration and nothing therein should be taken as a limitation upon the overall scope of the invention that is claimed.

Figure 1:
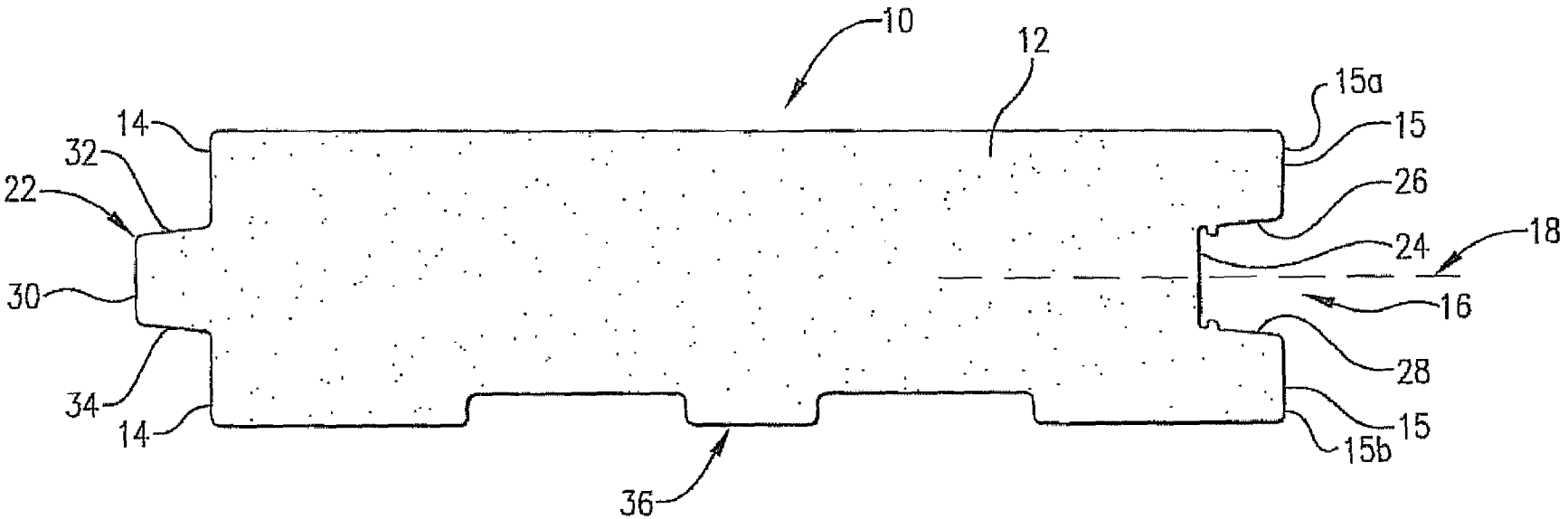
FIG. 1 illustrates an end view of a preferred plank in accordance with the invention.

Referring to FIG. 1, an end view of a preferred plank 10 in accordance with the present invention is provided. The plank 10 comprises a body 12, presenting a first edge surface 14, a second edge surface 15, and an underside 36. The first edge surface 14 includes a tongue 22 extending from the first edge surface 14. The tongue 22 comprises a tongue end wall 30 and a pair of tongue side walls 32, 34 extending between the tongue end wall 30 and the first edge surface 14. The second edge surface 15 comprises an upper edge surface 15*a* and a lower edge surface 15*b*, and includes a groove 16 projecting inwardly from the second edge surface 15 along a groove axis 18. The groove 16 is defined by a groove end wall 24 and a pair of groove side walls 26, 28, extending between the groove end wall 24 and the second edge surface 15. It will be appreciated that although the underside 36 of the plank 10 illustrated in FIG. 1 is contoured, planks, boards, or panels can be provided with an underside 36 having a different contour, or being flat, without going beyond the scope of the present invention. It will also be appreciated that the present invention is not limited only to planks having a tongue extending from the first edge surface 14 and a groove projecting inwardly from the second edge surface 15. Rather, planks can be adapted in a number of ways, depending upon the final desired use, in accordance with the present invention. For example, a plank can be configured to have two grooves or two tongues, one on each of the first and second edge surfaces 14, 15, respectively. It is also envisioned that a plank in accordance with the present invention can have a groove or a tongue on one edge surface only with the other edge surface having neither a tongue nor a groove, depending upon the final desired assembly.

Figure 2B:
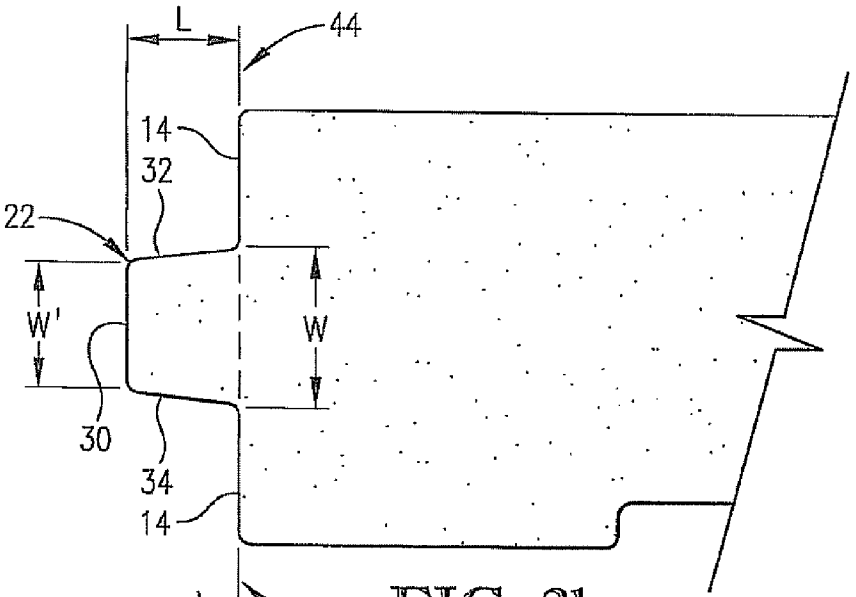
FIG. 2*b* depicts an enlarged profile view of a preferred tongue, and illustrates preferred tongue dimensions.
Figure 2A:
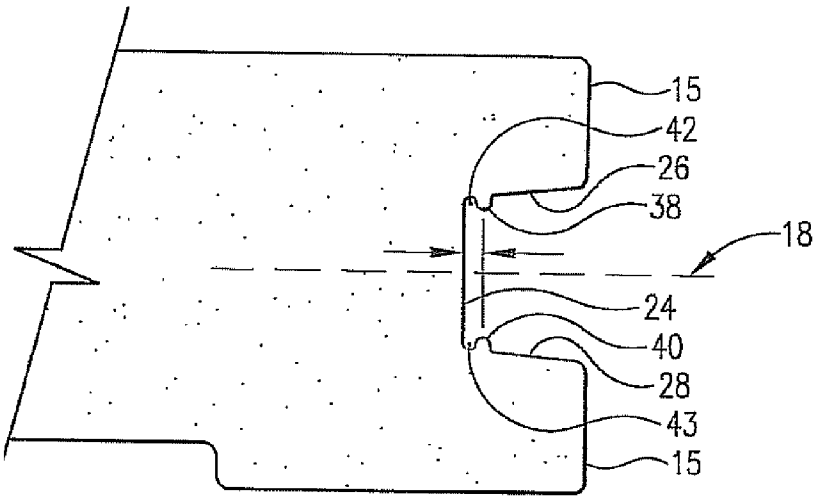
FIG. 2*a* depicts an enlarged profile view of a preferred groove.

FIGS. 2*a*-2*b* illustrate an enlarged view of a preferred groove 16 and a preferred tongue 22 in accordance with the present invention. In more detail, as shown in FIG. 2*a*, the groove side walls 26, 28 present generally opposed tongue-engaging projections 38, 40, respectively, in alignment substantially perpendicular to the groove axis 18, and spaced from the groove end wall 24, to define respective spaces 42, 43 between the projections 38, 40 and the groove end wall 24. The respective spaces 42, 43 are preferably from about 0.50 mm to about 1.8 mm, more preferably from about 0.6 mm to about 1.6 mm, and even more preferably from about 0.8 mm to about 1.0 mm, when measured from the groove end wall 24 to the center of each tongue-engaging projection 38, 40. As shown in FIG. 2*b*, the preferred tongue 22 has a length "L" being defined between the tongue end wall 30 and a plane 44 coinciding with that created by the first edge surface 14; a width "W" being defined as the greatest distance between the tongue side walls 32, 34; and a width "W'" being defined as the shortest distance between the tongue side walls 32, 34. In a particularly preferred embodiment, the tongue side walls 32, 34 are inwardly sloped to narrow the distance between the side walls 32, 34, and terminating at the tongue end wall 30, causing the tongue 22 to be tapered when viewed from the side. In this embodiment, the length of W' is less than the length of W. More particularly, W' is at least about 60% the length of W, preferably from about 60% to about 100% the length of W, more preferably from about 70% to about 90% the length of W, and even more preferably at least about 82% the length of W. As shown in FIG. 2*a*, the groove side walls 26, 28 are also preferably inwardly sloped to narrow the distance between the groove side walls 26, 28, and terminating at the groove end wall 24, creating a tapered groove 16 corresponding to the tapered tongue 22.

Figure 3:
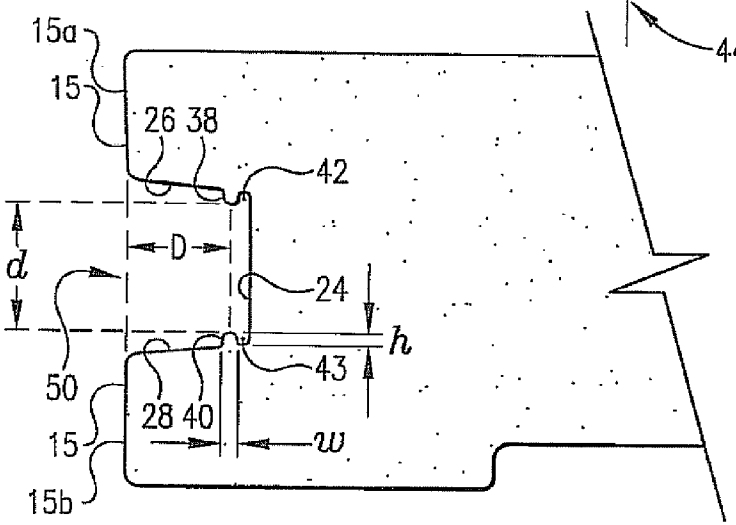
FIG. 3 provides an additional view of a preferred groove to illustrate preferred groove dimensions.

The dimensions of a preferred groove are shown in more detail in FIG. 3. The tongue-engaging projections 38, 40, respectively, extend from the groove side walls 26, 28, but are preferably spaced apart from each other, where "d" is the distance between the projections 38, 40. More preferably, the tongue-engaging projections are spaced apart from each other a distance d that is less than the width W' of the tongue 22 (shown in FIG. 2*b*).

The tongue-engaging projections 38, 40 also preferably have a height "h." The height h is measured from the highest point of the projections 38, 40 to their respective groove side walls 26, 28 on the respective sides of tongue-engaging projections 38, 40 that are adjacent the groove end wall 24. The tongue-engaging projections 38, 40 also preferably have a width "w," as measured from the widest portion of the tongue-engaging projections 38, 40. In a particularly preferred embodiment, the tongue-engaging projections 38, 40 have a height h of at least about 0.50 mm, preferably from about 0.70 mm to about 0.90 mm, and more preferably about 0.812 mm, and a width w of at least about 0.01 mm, preferably from about 0.02 mm to about 0.05 mm, and more preferably about 0.030 mm. It is also preferred that the height h be greater than the width w, more preferably at least about 2% greater, and even more preferably from about 2% to about 6% greater.

Figure 4:
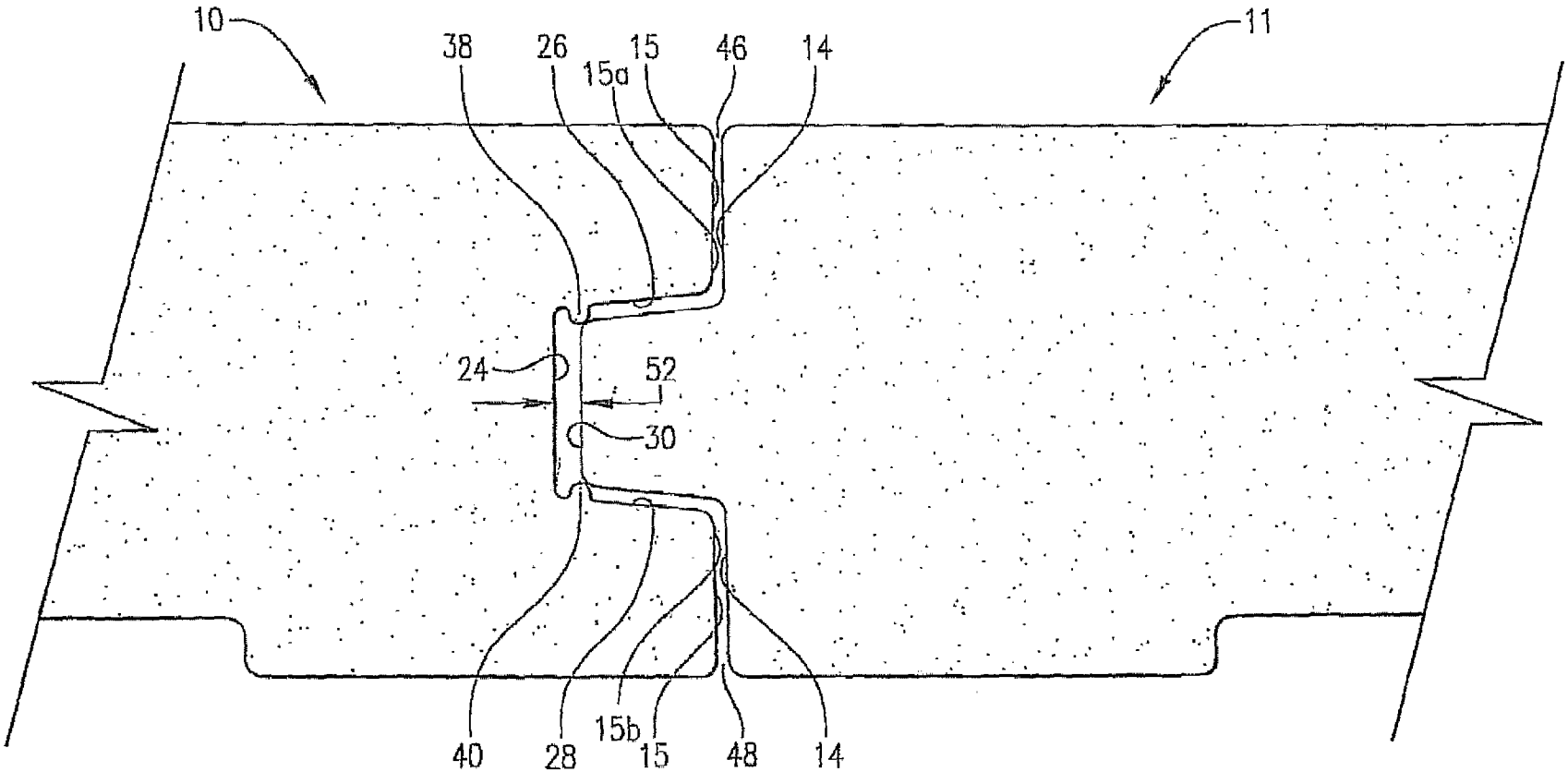
FIG. 4 depicts the profile of two preferred planks connected using the inventive tongue-and-groove combination.

As shown in FIG. 4, the groove 16 is configured to receive the tongue 22 of an adjacent plank 11. When assembled, the adjacent planks 10, 11 preferably have first and second spaces 46, 48, between the first edge surface 14 and the second edge surface 15 of each plank, and an interior space 52 between the groove end wall 24 and the tongue end wall 30. More particularly, the assembled planks have a first space 46 above the tongue-and-groove configuration and a second space 48 below the tongue-and-groove configuration. The first and second spaces 46, 48, respectively, should be from about 0.10 mm to about 1.5 mm, preferably from about 0.80 mm to about 1.2 mm, and more preferably from about 1.0 mm to about 1.2 mm. In a further preferred embodiment, the first and second spaces 46, 48 are different sizes, as shown in FIG. 4, with the lower edge surface 15*b* preferably being undercut and the first space 46 being smaller than the second space 48. In this embodiment, the second space 48 should be from about 1.0 mm to about 2.54 mm, preferably from about 1.6 mm to about 1.9 mm, more preferably from about 1.78 mm to about 1.9 mm. The interior space 52 between the groove end wall 24 and the tongue end wall 30 should be from about 1.2 mm to about 3.0 mm, preferably from about 1.75 mm to about 2.5 mm, more preferably from about 1.9 mm to about 2.25 mm.

The first and seconds spaces 46, 48, and the interior space 52 are determined by the placement of the tongue-engaging projections 38, 40 along the groove side walls 26, 28 in relation to the second edge surface 15. Referring again to FIG. 3, the tongue-engaging projections 38, 40 are preferably spaced from the second edge surface 15 a distance "D," as measured from the center of the tongue-engaging projections to a plane 50 extending along the second edge surface 15 of the plank 10. More preferably, the distance D is less than the length L of the tongue 22 of the adjacent plank 11. In particular, the distance D is preferably from about 40% to about 95% the length L, more preferably from about 60% to about 90% the length L, even more preferably from about 80% to about 85% the length L. In this embodiment, when the tongue 22 is received in the groove 16, the tongue-engaging projections 38, 40 engage the tongue 22, and more preferably the tongue end wall 30, to provide the desired spaces 46, 48, 52, respectively. Accordingly, the tongue-engaging projections 38, 40 should be strong enough to prevent the tongue 22 of the adjacent plank 11 from being forced past the tongue-engaging projections 38, 40 and into the groove end wall 24 during installation of the plank system. It is also preferred that the tongue-engaging projections 38, 40 are integrally formed with the material forming the plank 10. In other words, the entire plank 10 unitarily formed.

The planks can be made from any suitable material including sized lumber, synthetic materials, and wood composites. When formed from natural woods, the novel tongue-and-groove configuration can be formed for example, by conventional routering methods. A preferred method for forming wood composites with the novel tongue-and-groove configuration is by extrusion so that the tongue-and-groove configuration, including the tongue-engaging projections, are integrally formed with the material forming the planks.

In particular, a preferred method for making wood composites can be found in U.S. Pat. No. 6,737,006, incorporated by reference herein. In more detail, the products are formed by introducing ingredients including respective quantities of a fibrous or cellulosic material and polypropylene into the inlet of an extruder (preferably a twin screw extruder). Preferably, the weigh blender is positioned immediately above the extruder, at the extruder inlet, so that the blend of ingredients is formed immediately prior to entering the extruder, thus minimizing or preventing separation of the ingredients.

The screw(s) is then rotated at a rate of from about 10-50 rpm, and preferably from about 15-34 rpm to advance the ingredients through the extruder barrel and out the extrusion die to form the composite product. The die is configured to present an orifice configured to correspond to the desired plank or board profile, including the tongue-engaging projections 38, 40. Preferably, the screw(s) has a compression ratio of from about 2:1 to about 4:1, and more preferably from about 2.8:1 to about 3.6:1.

The temperature of the ingredients in the extruder barrel is preferably from about 150-260° C., and more preferably from about 175-230° C. The retention time of the ingredients in the barrel should be from about 20-120 seconds, and more preferably from about 40-80 seconds. Finally, the ingredients should be advanced through the barrel at a rate of from about 500-2,000 lbs/hr., and more preferably from about 1,000-1,500 lbs/hr.

The fibrous material is preferably present in the ingredients at a level of from about 20-80% by weight, more preferably from about 30-70% by weight, and even more preferably from about 50-70% by weight, based upon the total weight of the ingredients taken as 100% by weight. The polypropylene is preferably present in the ingredients at a level of from about 20-80% by weight, more preferably from about 30-70% by weight, and even more preferably from about 30-50% by weight, based upon the total weight of the ingredients taken as 100% by weight.

Preferred fibrous materials include those selected from the group consisting of sawdust, newspaper, alfalfa, wheat pulp, wood scraps (e.g., ground wood, wood flour, wood flakes, wood chips, wood fibers, wood particles), wood veneers, wood laminates, cardboard, straw, cotton, rice hulls, paper, coconut shells, peanut shells, bagasse, plant fibers, bamboo fiber, palm fiber, kenaf, and mixtures thereof. Furthermore, the average particle size of the fibrous material should be less than about ½ inch, and more preferably from about 1/16-¼ inch. Finally, the particles of the fibrous material should have an average aspect ratio (i.e., the ratio of the length to the widest thickness) of at least about 10:1, preferably at least about 20:1, and more preferably from about 30:1 to about 50:1. The use of such long particles increases the flexural modulus of the product as compared to products with lower aspect ratios by at least about 25%, and preferably at least about 40%, thus causing the final composite product to have a stiffness comparable to natural wood.

The preferred polypropylene for use in the invention is reactor flake polypropylene (i.e., the polymer flakes as they are produced in the reactor), preferably without any further treatment (e.g., without the addition of chemical additives or modifiers) to the polypropylene. The preferred polypropylene has a melt index at 230° C. of from about 0-10 g/10 min., preferably from about 0.1-4 g/10 min., and more preferably from about 0.1-1 g/10 min. Furthermore, it is preferred that the polypropylene has a bulk density of from about 20-40 lbs/ft$^3$, and more preferably from about 28-32 lbs/ft$^3$. The average fiber length or particle size of the polypropylene flakes utilized should be from about 350-1,000 μm, and preferably from about 500-700 μm.

The resulting composite product is in the form of a self-sustaining body and has an ASTM D-6109 flexural modulus of from about 600-1,100 psi, and preferably from about 800-1,100 psi. The product should have an actual density of from about 40-60 lbs/ft$^3$, and preferably from about 50-58 lbs/ft$^3$.

A number of optional ingredients can also be added to modify or adjust the properties of the final composite product. Examples of such ingredients include acrylic process aids (e.g., Rohm and Haas K175, Kaneka Kane-AcePA-101), UV stabilizers (e.g., CYTEC 38535, CYTEC 3346), and coloring agents. If a process aid is utilized, it is preferably present in the ingredients at a level of from about 0.5-5% by weight, and more preferably from about 1-2% by weight, based upon the total weight of the ingredients taken as 100% by weight. Unexpectedly, these acrylic process aids are particularly useful in the present invention in spite of the fact that they are intended to be used in PVC products rather than polypropylene products.

Figure 5:
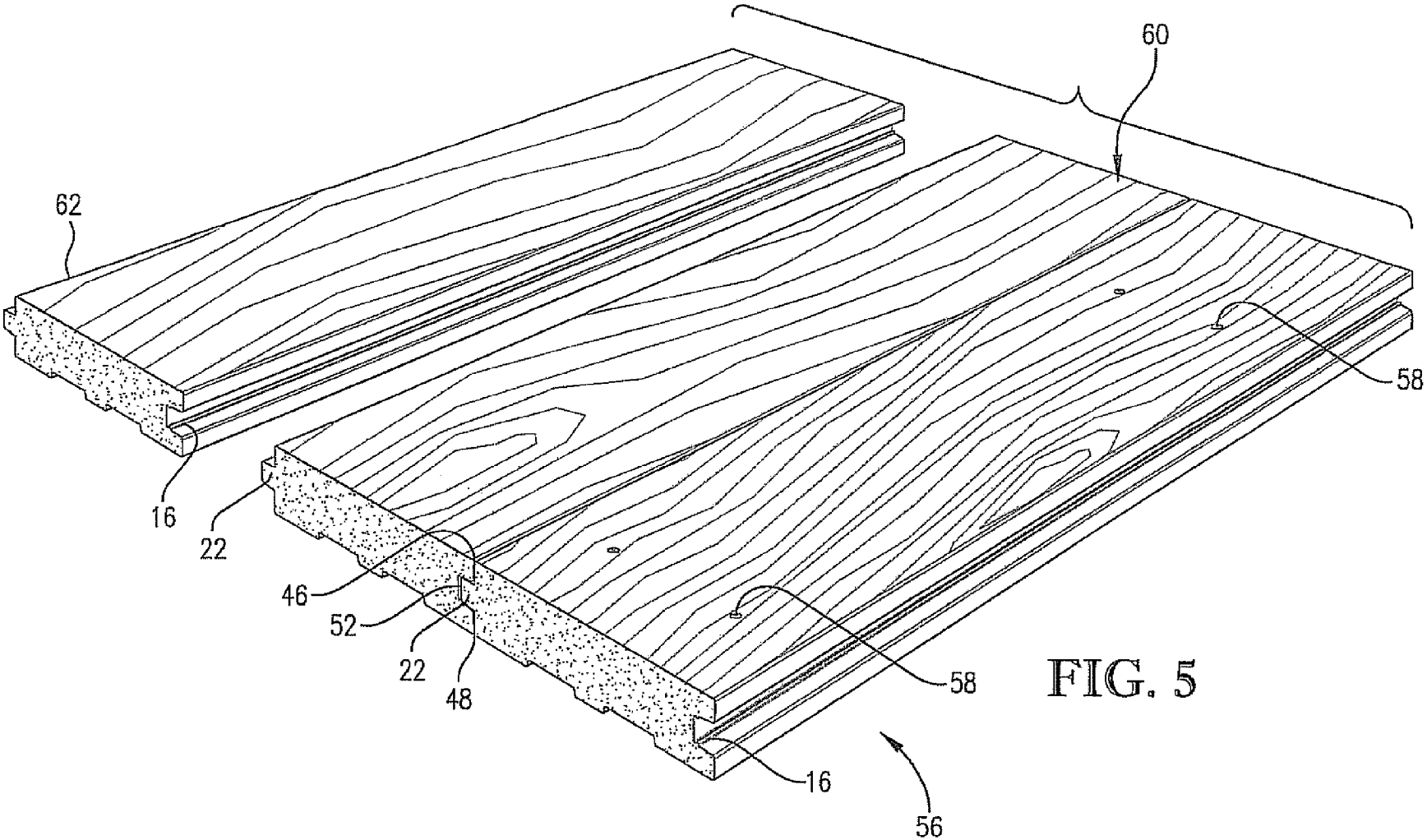
FIG. 5 depicts a top view of the novel planking system and method utilizing the tongue-and-groove combination of the present invention.

In use, the planks can be assembled and secured using traditional methods, including by securing through the face of the board, or through the tongue and/or groove, depending upon the final desired use. With reference to the plank system illustrated in FIG. 5, a preferred method of assembly comprises the steps of securing a first starter plank 56 to a support (not shown). Preferably, the starter plank is secured through the face of the board using any suitable fastening device 58 (e.g., deck screws, nails, etc.). Next, a second plank 60 is positioned adjacent the starter plank 56 and the tongue 22 of the starter plank 56 is inserted into the groove 16 of the second plank 60 until the tongue end wall 30 is engaged by the tongue-engaging projections 38, 40 in the groove 16. The second plank is then secured, preferably, through the tongue of the second plank (see FIG. 6). More preferably, the second plank is secured by countersinking a nail, screw, or other fastening device 58 into the tongue 22, so that it does not obstruct the tongue from being subsequently received into the groove of the next adjacent plank 62. This preferred method automatically provides the desired first and second spaces 46, 48, respectively, between each plank, with the first space 46 between the planks being above the tongue-and-groove configuration and the second space 48 between the planks being below the tongue-and-groove configuration.

Figure 6:
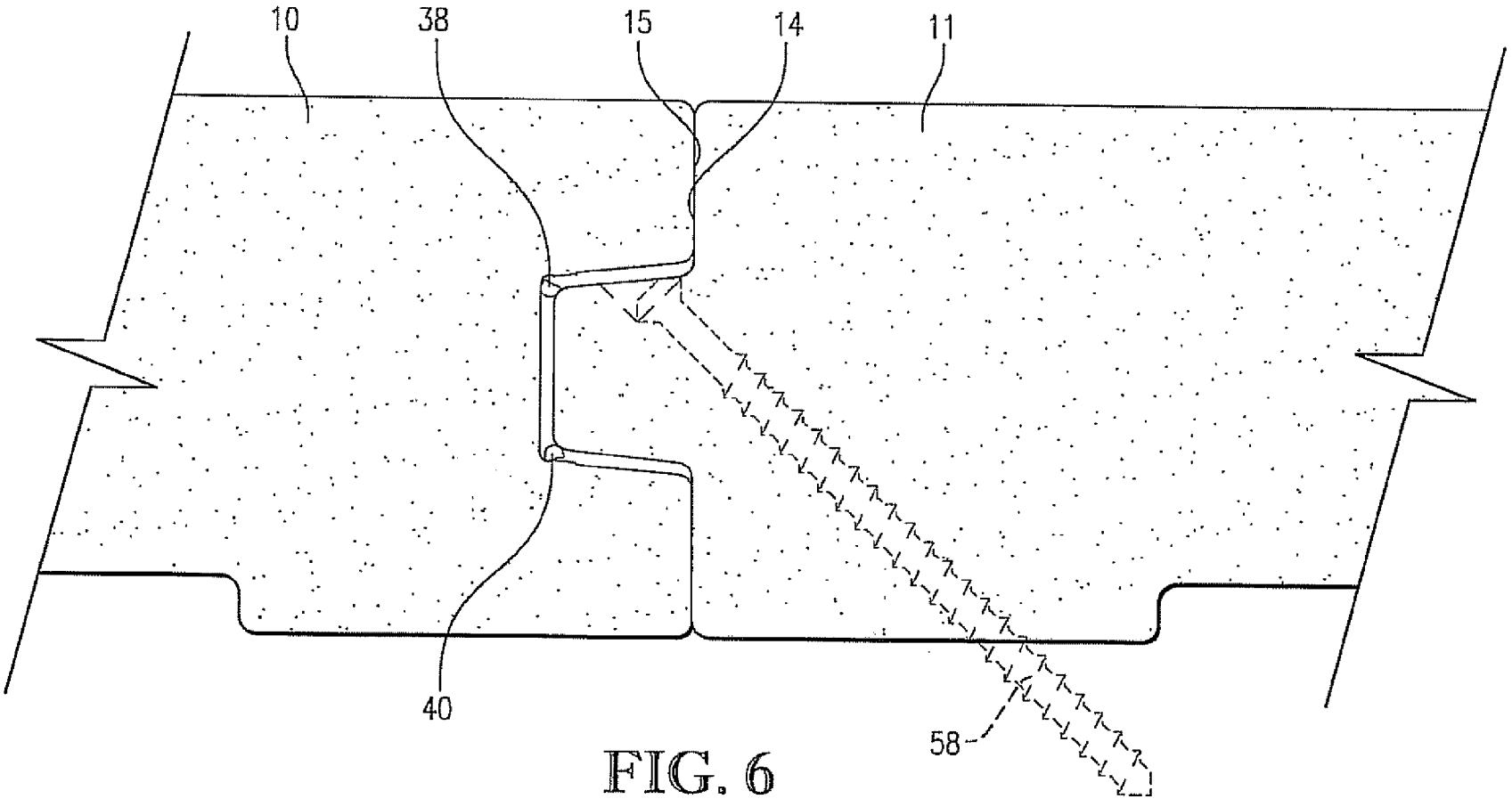
FIG. 6 depicts the expansion of the planks after installation, and the shearing off of the tongue-engaging projections that occurs upon expansion.

With reference to FIG. 6, the tongue-engaging projections 38, 40 should be configured to shear or break away when a given force is generated by expansion of planks 10 and/or 11 after installation. As shown in FIG. 6, the assembled planks 10, 11 utilizing the novel tongue-and-groove configuration have swelled and expanded. In particular, the second edge surface 15 of the plank 10 has expanded into the first edge surface 14 of the adjacent plank 11, and the tongue-engaging projections 38, 40 have been sheared or broken away by the tongue 22 of the adjacent plank 11 to permit this expansion. In this manner, the novel plank system and method allow for the planks to expand during temperature and/or moisture level changes, thereby preventing buckling of the assembled planks, in particular, when the planks are formed of high compressive strength composite materials.

It will be appreciated by those skilled in the art that although the foregoing description has been given with reference to planks having a length and respective end portions, the novel tongue-and-groove configuration and spacing system can be adapted to a wide number of areas, in addition to porch planking. In particular, the novel tongue-and-groove arrangement can be adapted to accommodate any application where wood and/or wood composites are commonly used, such as in wood and simulated wood flooring, decking, wall paneling, and roof paneling, door sills and jambs, fascia board, window edging, window sills, decorative architectural trim (e.g., deck or patio railing), and landscaping products (e.g., raised bed edging, flowerbed edging, driveway edging). It will also be appreciated that the inventive tongue-and-groove configuration can extend along the length of the planks, panels, or boards. However, the tongue-and-groove configuration can also be segmented along the length of the planks, panels, or boards, without going beyond the scope of this invention.

We claim:

1. A method of assembling porch planks to accommodate expansion and contraction of the assembled planks, said method comprising:

securing a first plank to a support, said first plank presenting a first edge surface and a tongue extending from said first edge surface, said tongue comprising:

a tongue end wall; and a pair of tongue side walls extending between the tongue end wall and said first edge surface; and positioning a second plank adjacent said first plank, said second plank presenting a second edge surface and a groove projecting inwardly from said second edge surface along a groove axis, said groove comprising:

a groove end wall; and a pair of groove side walls extending between said groove end wall and said second edge surface, said groove side walls presenting generally opposed tongue-engaging projections spaced from said groove end wall and from said second edge surface in alignment substantially perpendicular to said groove axis, wherein said positioning comprises inserting said tongue into said groove so that the tongue is received in the groove and said tongue end wall is directly engaged by said tongue-engaging projections, thereby providing an interior space between said tongue end wall and groove end wall, and first and second spaces between said first edge surface and second edge surface.

2. The method of claim 1, wherein said second plank is unitarily formed.

3. The method of claim 1, wherein said tongue-engaging projections are shearable upon encountering pressure from said first plank upon the expansion of one or both of said planks, so as to prevent said assembled planks from buckling.

4. The method of claim 1, said tongue having a tongue length being defined between said tongue end wall and a plane coinciding with the plane of said first edge surface, and a tongue width being defined between said tongue side walls, wherein said tongue-engaging projections are spaced apart a distance that is less than said tongue width, and are spaced from said second edge surface a distance that is less than said tongue length.

5. The method of claim 1, wherein said first and second planks comprise a wood composite material.

6. A combination of planks utilizing a tongue-and-groove arrangement comprising:

a first plank, presenting a first edge surface and a tongue extending from side first edge surface, said tongue comprising:

a tongue end wall; and a pair of tongue side walls extending between the tongue end wall and said first edge surface; and second plank adjacent said first plank, said second plank presenting a second edge surface and a groove projecting inwardly from said second edge surface along groove axis, and receiving said tongue, said groove comprising:

a groove end wall; and a pair of groove side walls extending between said groove end wall and said second edge surface, said groove side walls presenting generally opposed tongue-engaging projections spaced from said groove end wall in alignment substantially perpendicular to said groove axis, said tongue having a tongue width being defined as the narrowest distance between said tongue side walls, wherein said tongue-engaging projections are spaced apart a distance that is less than said tongue width, thereby engaging said tongue end wall.

7. The combination of claim 6, said tongue having a tongue length being defined between said tongue end wall and a plane coinciding with the plane of said first edge surface, wherein said tongue-engaging projections are spaced from said second edge surface a distance that is less than said tongue length, thereby engaging said tongue end wall, and providing an interior space between said tongue end wall and groove end wall, and first and second spaces between said first edge surface and second edge surface.

8. The combination of claim 6, each of said planks having respective lengths and respective end portions, wherein said tongue-and-groove arrangement extends along the length of said planks and terminates at the respective end portions.

9. The combination of claim 6, wherein said tongue side walls are inwardly sloped, terminating at said tongue end wall resulting in a tapered tongue, and wherein said groove side walls are inwardly sloped, terminating at said groove end wall to correspond to said tapered tongue.

10. The combination of claim 6, said projections having a height of at least about 0.031 mm.

11. The combination of claim 6, said projections having a width of at least about 0.030 mm.

12. A method of assembling porch planks to accommodate expansion and contraction of the assembled planks, said method comprising:

securing a first plank to a support, said first plank presenting a first edge surface and a tongue extending from said first edge surface, said tongue comprising:

a tongue end wall; and a pair of tongue side walls extending between the tongue end wall and said first edge surface; and positioning a second plank adjacent said first plank, said second plank presenting a second edge surface and a groove projecting inwardly from said second edge surface long a groove axis, said groove comprising:

a groove end wall; and a pair of groove side walls extending between said groove end wall and said second edge surface, said groove side walls presenting generally opposed tongue-engaging projections spaced from said groove end wall in alignment substantially perpendicular to said groove axis, said tongue having a tongue length being defined between said tongue end wall and a plane coinciding with the plane of said first edge surface, and a tongue width being defined between said tongue side walls, wherein said tongue-engaging projections are spaced apart a distance that is less than said tongue width, and are spaced from said second edge surface a distance that is less than said tongue length, wherein said positioning comprises inserting said tongue into said groove so that the tongue is received in the groove and said tongue end wall is engaged by said tongue-engaging projections, thereby providing an interior space between said tongue end wall and groove end wall, and first and second spaces between said first edge surface and second edge surface.

13. The method of claim 12, wherein said second plank is unitarily formed.

14. The method of claim 12, wherein said tongue-engaging projections are shearable upon encountering pressure from said first plank upon the expansion of one or both of said planks, so as to prevent said assembled planks from buckling.

15. The method of claim 12, wherein said first and second planks comprise a wood composite material.

* * * * *